United States Patent [19]

Takken et al.

[11] Patent Number: 5,065,469

[45] Date of Patent: Nov. 19, 1991

[54] APPARATUS FOR REMOVING DEBRIS FROM A CUTTING BED

[75] Inventors: Paul E. Takken, Hudsonville; Robert G. Scheckel, Nunica, both of Mich.; Steven D. Peo, Michigan City, Ind.

[73] Assignee: BPS Systems, Inc., Hudsonville, Mich.

[21] Appl. No.: 420,171

[22] Filed: Oct. 12, 1989

[51] Int. Cl.[5] ..... B08B 11/02; B08B 7/02

[52] U.S. Cl. ..... 15/89; 134/32; 414/737

[58] Field of Search ..... 15/89, 91, 92, 94; 134/32; 414/737, 627; 29/81.15

[56] References Cited

U.S. PATENT DOCUMENTS

| | | | |
|---|---|---|---|
| 844,154 | 2/1907 | Long . | |
| 1,155,242 | 9/1915 | Johnson . | |
| 1,375,642 | 4/1921 | Russell | 15/89 |
| 1,570,716 | 1/1926 | Stoney | 15/94 |
| 2,250,015 | 7/1941 | Fraas | 15/94 |
| 2,874,398 | 2/1959 | Di Persio | 15/94 |
| 3,039,623 | 6/1962 | Sehn et al. | 414/737 |
| 3,902,605 | 9/1975 | Hamilton | 414/627 |
| 4,224,711 | 9/1980 | Gerber | 15/89 |

*Primary Examiner*—Edward L. Roberts

*Attorney, Agent, or Firm*—Price, Heneveld, Cooper, DeWitt & Litton

[57] ABSTRACT

A method and apparatus for cleaning debris, such as lint-like residue, from the bristle blocks of an automatic fabric cutting machine cutting bed, utilizing a linear motion device connected to a head by motion-amplifying linkages in order to amplify the acceleration produced by the motion device and thereby accelerate a slat of bristle blocks toward a grate. When the slat contacts the grate it is abruptly decelerated, which causes the debris to travel out from between the bristles. The grate is indexed between cycles of the head so that different portions of the slat strike the grate each cycle.

29 Claims, 5 Drawing Sheets

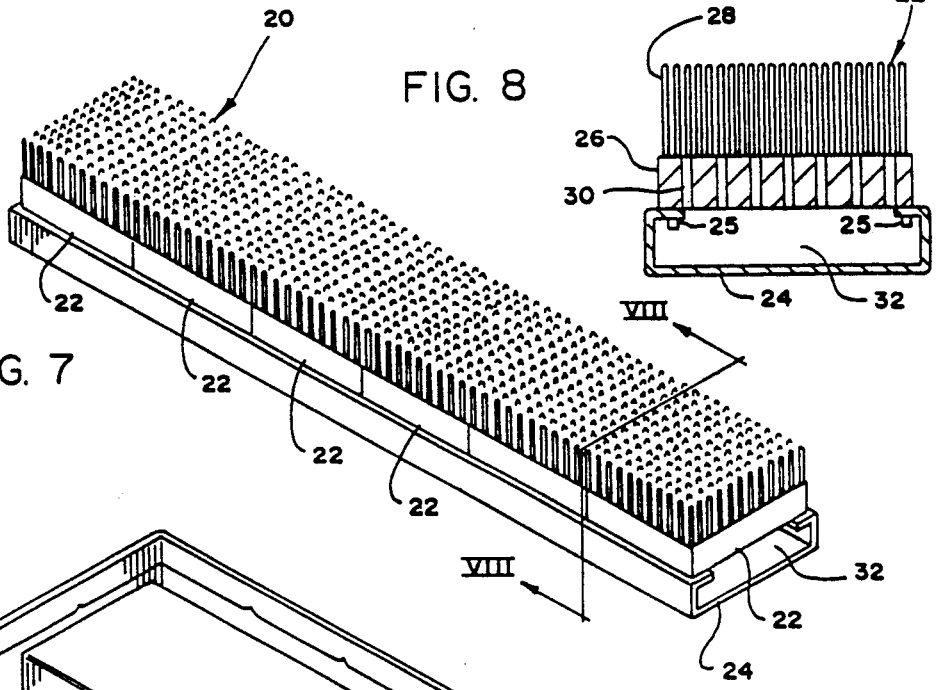
FIG. 7
FIG. 8
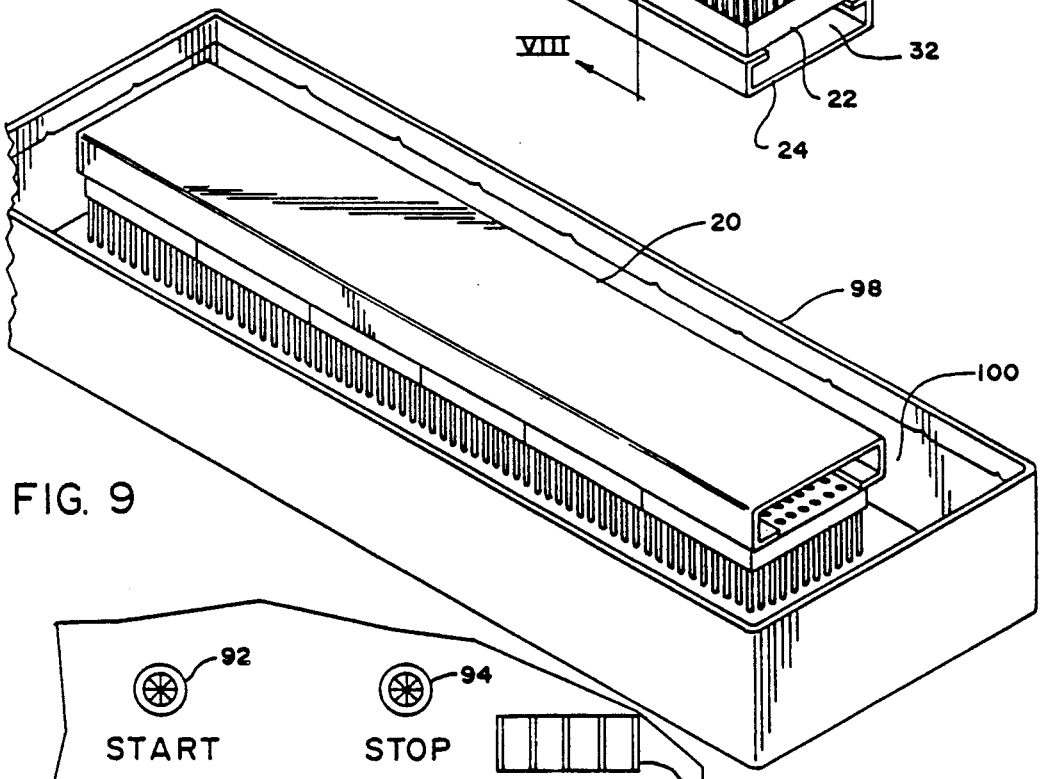
FIG. 9
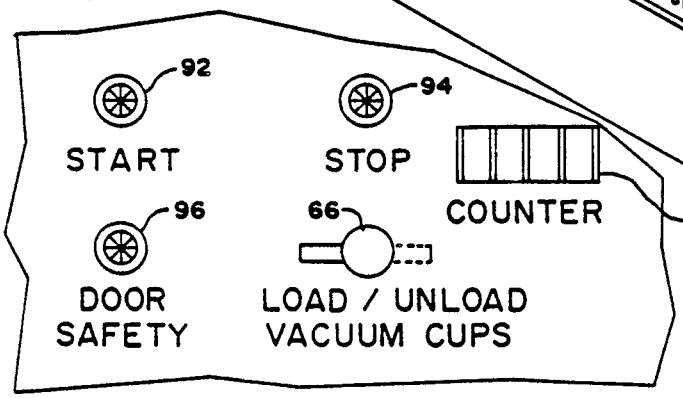
FIG. 10

APPARATUS FOR REMOVING DEBRIS FROM A CUTTING BED

BACKGROUND OF THE INVENTION

This invention relates to a cleaning apparatus and method. The invention is especially adapted for removing debris that has become embedded in a substrate. More particularly, the invention concerns the removal of lint-type residue from the cutting bed of an automated fabric cutting machine.

In one type of automated cutting machine for cutting limp fabrics, multiple layers of the fabric are supported on a cutting surface or bed. The cutting bed is made of tightly-packed, polymeric bristles through which a cutting knife can be directed without damaging the bristles, which flex when contacted by the knife. In order to hold the layers of limp fabric to the cutting bed, a vacuum is drawn through a plurality of micro openings in the base of the bed and the fabric is covered with a thin film of plastic to draw the material against the bristles. As a numerically-controlled knife cuts the multiple layers of fabric, a residue of lint-like debris is pulled by the vacuum deep into the nap of the bristles. A buildup of such debris closes the micro openings in the bristle blocks thus restricting the effectiveness of the vacuum hold-down method. Accordingly, such debris must be periodically removed from the cutting bed.

Such a cutting bed is typically divided into a plurality of elongated slats which are mounted to a chain in order to form a conveyor. Each slat is made from a plurality of square bristle blocks mounted to a U-shaped channel which forms a plenum for applying vacuum to the back of each bristle block. In order to dislodge the debris from the bristle blocks, it is necessary to disassemble the slats from the conveyor and to remove the individual bristle blocks from the backing channel. The bristle blocks are then inverted and manually tapped against a solid surface in order to dislodge the debris. The bristle blocks may optionally be soaked in water in order to provide weight to the debris and to minimize airborne particles from the cleaning operation. The need, therefore, exists for a more efficient and less labor-intensive method of removing lint-like debris from the cutting bed of automated fabric cutting machines.

SUMMARY OF THE INVENTION

In order to remove debris from a substrate, such as the cutting bed of an automated fabric cutting machine, the substrate is supported by a head and the head is accelerated in a given direction by mover means which include means for producing linear movement and linkage means for amplifying the linear movement when applied to the head. Deceleration means decelerates the head after the head has been accelerated. The amplifying means amplifies the acceleration produced by the linear movement means such that when the head is decelerated, a substantial force is developed on the debris, tending to dislodge it from the substrate.

According to one aspect of the invention, the force producing device is connected with the head by linkage means including at least one elongated member that is pivotally mounted at a pivot to a frame and is connected to the frame and to the head. By positioning the pivot such that the distance between the pivot and the connection with the frame is less than the distance between the pivot and the connection with the head, movement of the force producing device is amplified when transferred to the head.

According to another aspect of the invention, the deceleration means includes a grate positioned where it will be contacted by the moving substrate. Index means are provided for indexing the grate such that different portions of the substrate will contact lattice members of the grate. The indexing means is preferably synchronized with the reciprocal movement induced by the head moving means so that different portions of the substrate will contact the lattice members during subsequent cycles of head movement. This aspect of the invention reduces any tendency of debris to accumulate in portions of the substrate that contact the grate. These and other objects, advantages and features of this invention will become apparent upon review of the following specification in conjunction with the drawings.

BRIEF DESCRIPTION OF THE DRAWINGS

FIG. 7 is a perspective view of a substrate with which the present invention is primarily intended to be used;

FIG. 8 is a sectional view taken along the lines VIII—VIII in FIG. 7;

FIG. 9 is a perspective view illustrating a step in the method according to one aspect of the invention; and FIG. 10 is a partial front view of the controls of the apparatus shown in FIG. 1.

DESCRIPTION OF THE PREFERRED EMBODIMENT

Figure 1:
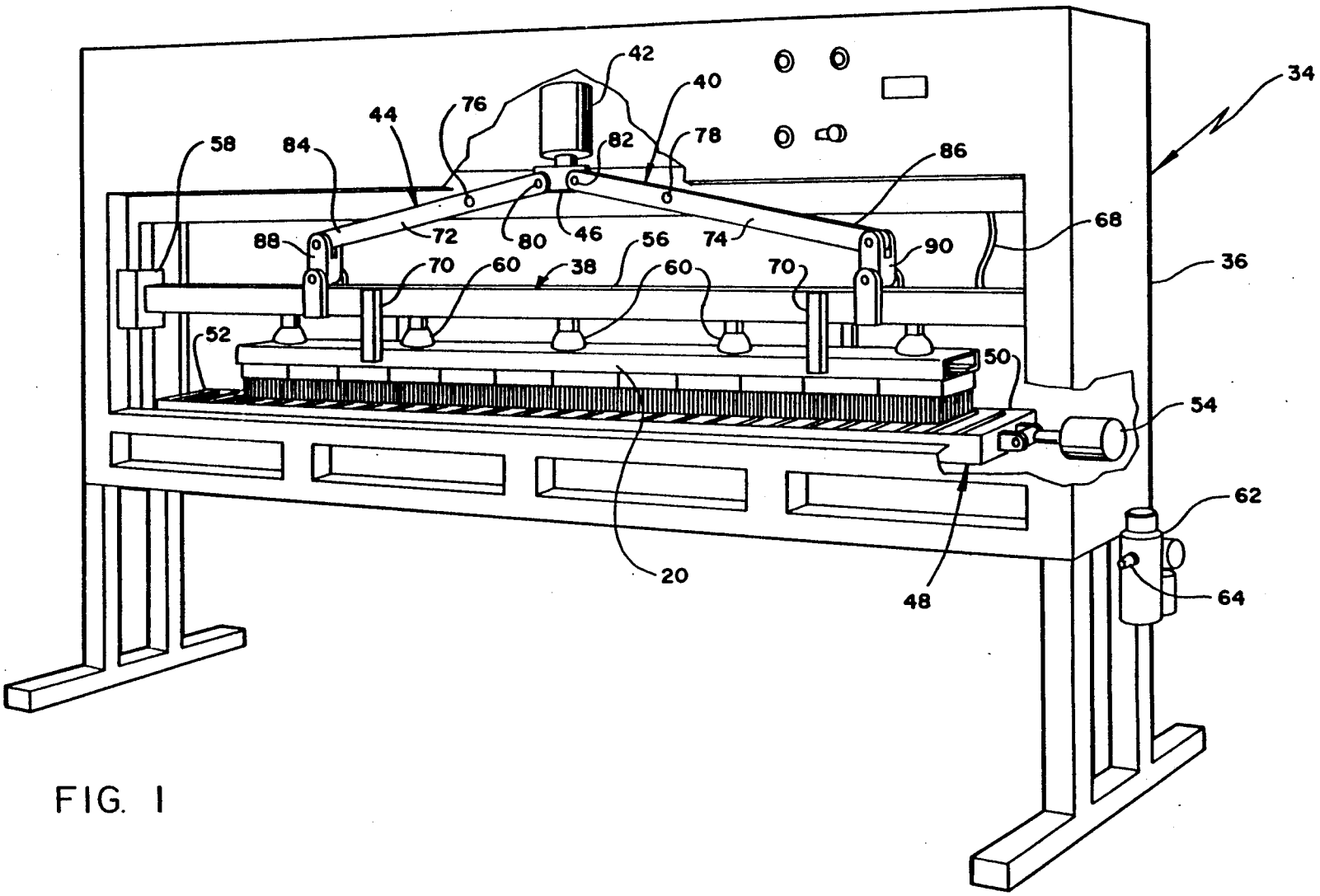
FIG. 1 is a perspective view of an apparatus according to the invention with the substrate-mounting head in a downward or extended position.

Referring now specifically to the drawings, and the illustrated embodiments depicted therein, the cutting bed of an automated limp fabric cutting machine is made from a plurality of bristle-block slats 20 (FIGS. 7 and 8). Each slat 20 is made up of a plurality of square bristle blocks 22 attached to a U-shaped channel 24 by mounting teats 25. Each bristle block 22 includes a base 26 and a multiplicity of bristles 28 extending away from base 26. Bristles 28 are integrally formed with base 26 from a polymer such as nylon or polypropylene by injection molding of the entire bristle block 22. A multiplicity of micro openings 30, which are illustrated in exaggerated form in FIG. 8, extend through base 26 to provide air flow communication between the interstices of bristles 28 and a plenum 32 defined by the walls of channel 24 and base 26. When in use on an automated fabric cutting machine, a plurality of bristle block slats 20 are combined in a cutting bed upon which multiple layers of fabric are piled. With a film covering the fabric and a vacuum drawn on plenums 32, the fabric is retained against the tips of bristles 28 while a numerically-controlled cutting knife cuts through the fabric pile in a saw-like stroke with the blade manipulating through the yielding bristles. An automated cutting machine of this type is manufactured by Gerber Garment Technology, Inc. in Tollend, Conn.

Use of such a cutting machine causes small fibers and other portions of the fabric to accumulate in the interstices of bristles 28 and to be drawn against base 26 by the suction applied to micro openings 30. When it is desired to remove such debris from the cutting bed, the individual slats 20 are disassembled from the bed and are mounted to a substrate cleaning apparatus 34 (FIGS. 1–6). Apparatus 34 includes a frame 36 and a head 38 which is vertically reciprocated by moving means generally illustrated at 40. Moving means 40 includes an extendable cylinder 42 mounted to frame 34 and linkage 44 interconnecting extendable portion 46 of cylinder 42 with head 38 in order to transfer motion of cylinder 42 to head 38. Moving means 40 moves head 38 in a vertically reciprocating motion toward and away from a grate 48. Grate 48 includes an outer frame 50 and a multiplicity of longitudinal lattice members 52 spaced along frame 50. Indexing means, such as extendable cylinder 54, is provided to index grate 48 laterally, or in a left-right motion. As illustrated in FIGS. 3–6. Cylinder 54 indexes grate 48 in synchronism with the reciprocal movement of head 38.

Head 38 includes an elongated member 56 which is guided for vertically reciprocating motion by suitable glide means 58 at opposite ends thereof. Elongated member 56 is made from a hollow, box-shaped steel member. A plurality of cups 60 protrude downwardly from member 56 and each include a suction passage (not shown) interconnected with the interior of elongated member 56 in order to apply suction force from the plenum defined within elongated member 56 to cups 60. The suction force is applied to the interior of elongated member 56 from a venturi vacuum pump, illustrated at 62, which produces a suction force when compressed air is applied to it. In the illustrated embodiment, the venturi vacuum pump is capable of drawing a vacuum of 27 inches Hg at 60 psi input. Outlet 64 of vacuum pump 62 is connected through a vacuum switch 66 and hence through a flexible hose 68 to the interior of elongated member 56. The suction produced by vacuum pump 62 and connected through elongated member 56 to suction cups 60, provides means for attaching an entire slat 20 to head 38. The suction applied to suction cups 60 is drawn against the flat surface of U-shaped channel 24 to produce firm attachment. A plurality of guide bars 70, extending downwardly from elongated member 56, prevent shifting of the slat away from the centerline of elongated member 56.

Linkage 44 includes a pair of elongated members 72, 74 which are pivotally mounted to frame 36 by pivots 76, 78. A first end 80, 82 is attached to extendable portion 46 of cylinder 42 and an opposite second end 84, 86 is connected to elongated member 56 through links 88, 90. As may be seen by comparison of FIGS. 1 and 2, as extendable portion 46 of cylinder 42 is extended, elongated members 72, 74 pivot about pivots 76, 78, which raises second end 84, 86 upwardly. This motion is transferred through links 88, 90 to elongated member 56 in order to raise head 38. Links 88 and 90 are required in order to compensate for the variation in horizontal spacing between ends 84, 86 of elongated members 72 and 74 as head 38 reciprocates between the positions illustrated in FIGS. 1 and 2. In a preferred embodiment, links 88 and 90 are made from a self-lubricating resinous plastic such as PTFE.

The distance between pivots 76, 78 and respective first ends 80, 82 is substantially less than the distance between pivots 76, 78 and second end 84, 86. Because of this arrangement, linear movement of extendable portion 46 will be amplified when transferred to head 38. In a preferred embodiment, the distance between pivots 76, 78 and first ends 80, 82 is approximately one-half of the distance between pivots 76, 78 and second ends 84, 86. This produces an approximate doubling of the vertical movement of extendable portion 46 when applied to head 38. In the illustrated embodiment, head 38 travels six inches in response to three-inch travel of extendable portion 46. Importantly, this amplification of motion additionally amplifies the level of acceleration achieved by head 38 as it moves downwardly to the position illustrated in FIG. 1. This amplified acceleration increases the force tending to dislodge debris from the bristle blocks.

In the illustrated embodiment, extendable cylinders 42 and 54 are double-acting, pneumatically-actuated cylinders having 2 inch bores and 3 inch strokes. Such extendable cylinders are marketed by American Cylinder Company. Cylinder 42 is operated in a continuous oscillatory motion in which portion 46 is extended and retracted by a reversing valve which reverses the actuating air flow to the input ports of cylinder 42. The reversing valve (not shown) is, in turn, actuated by a flow-sensing valve (not shown) which senses the decrease in air flow when extendable portion 46 reaches a fully extended or a fully retracted position. Because separate velocity adjustments are available with cylinder 42 for each direction of travel, the velocity of head 38 moving upwardly away from grate 48 is made less than the velocity moving toward the grate. This prevents partially dislodged debris from becoming relodged within the bristle nap during the up-stroke of the head.

Air cylinder 54 is actuated from a pneumatic flip-flop valve which receives an input from the reversing valve feeding cylinder 42. In this manner, cylinder 54 is actuated in a given direction once for every two actuations of cylinder 42, for a purpose that will be set forth below. By adjusting the air flow to cylinder 42, the rate of reciprocation of head 38 and grate 48 may be controlled. In the illustrated embodiment, cleaning apparatus 34 is operated from 100 psi compressed air at 28 cfm. This results in 1.5 to 2 cycles per second of head 38. The actuation of cylinders 42 and 54 are controlled through start and stop switches 92 and 94 and a cycle counter 102. By utilizing a venturi vacuum pump 62 to produce suction, the entire substrate cleaning apparatus 34 can be operated with compressed air as its sole power source.

Figure 3:
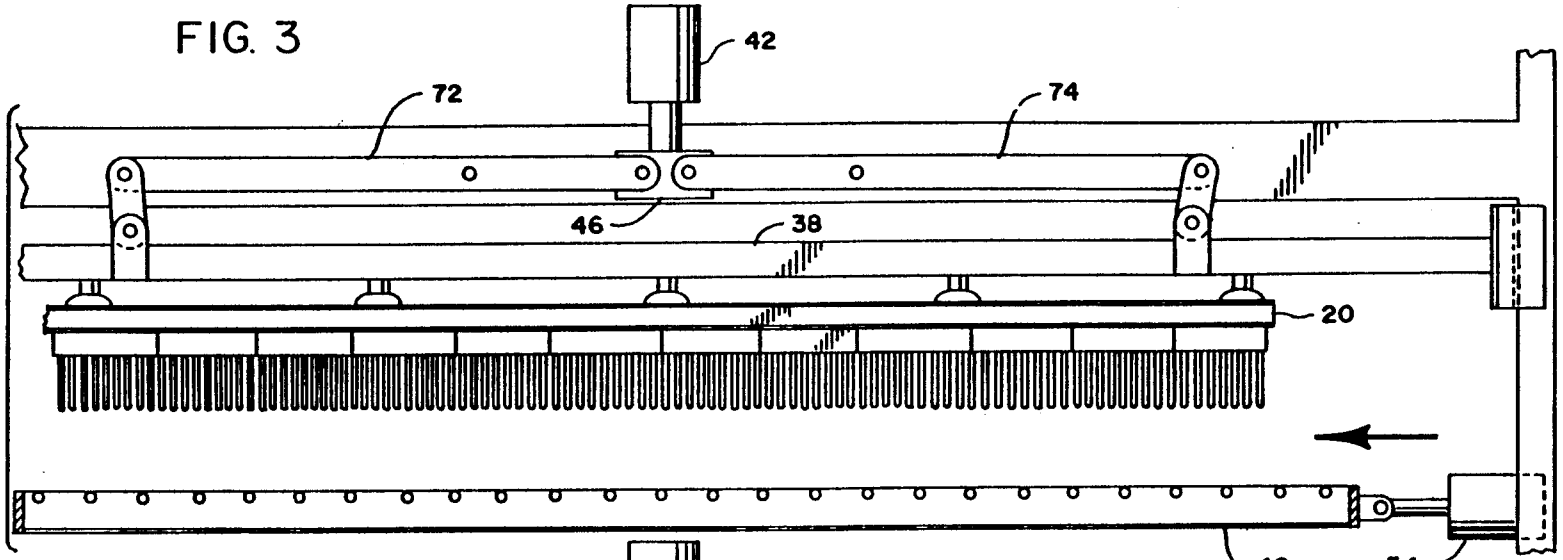
FIGS. 3–6 are partial front views of the apparatus in FIG. 1 illustrating synchronized movement of the head and indexing of the grate.
Figure 4:
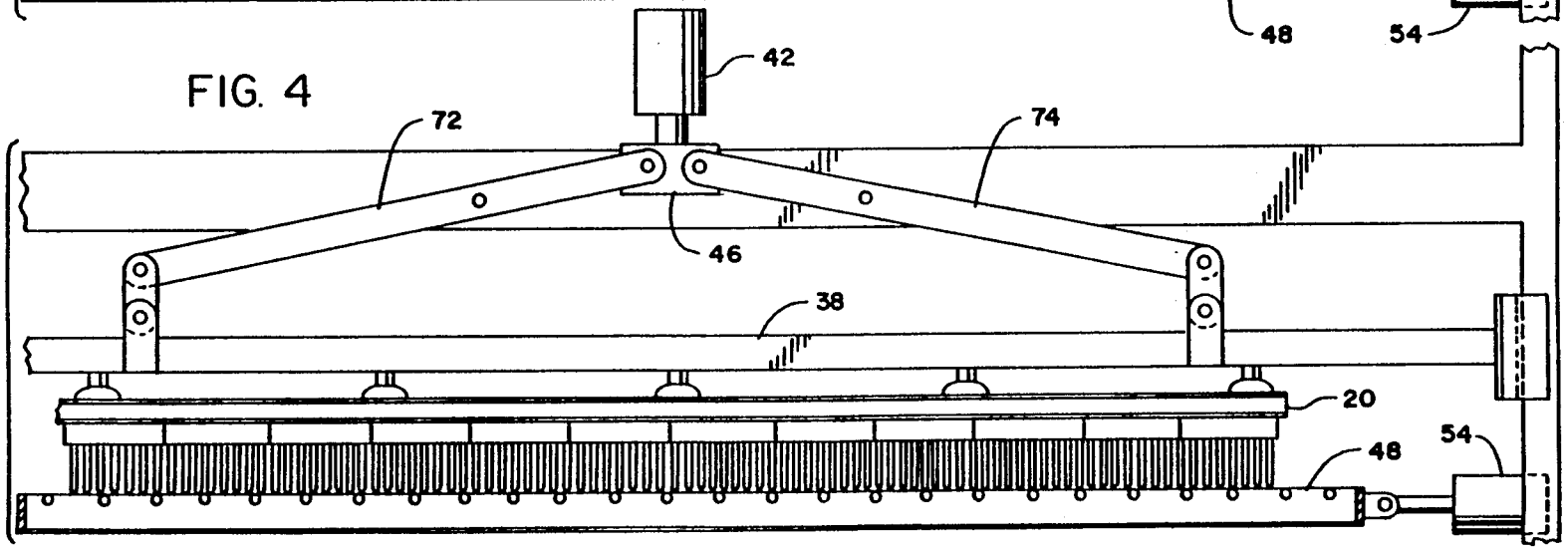
Figure 5:
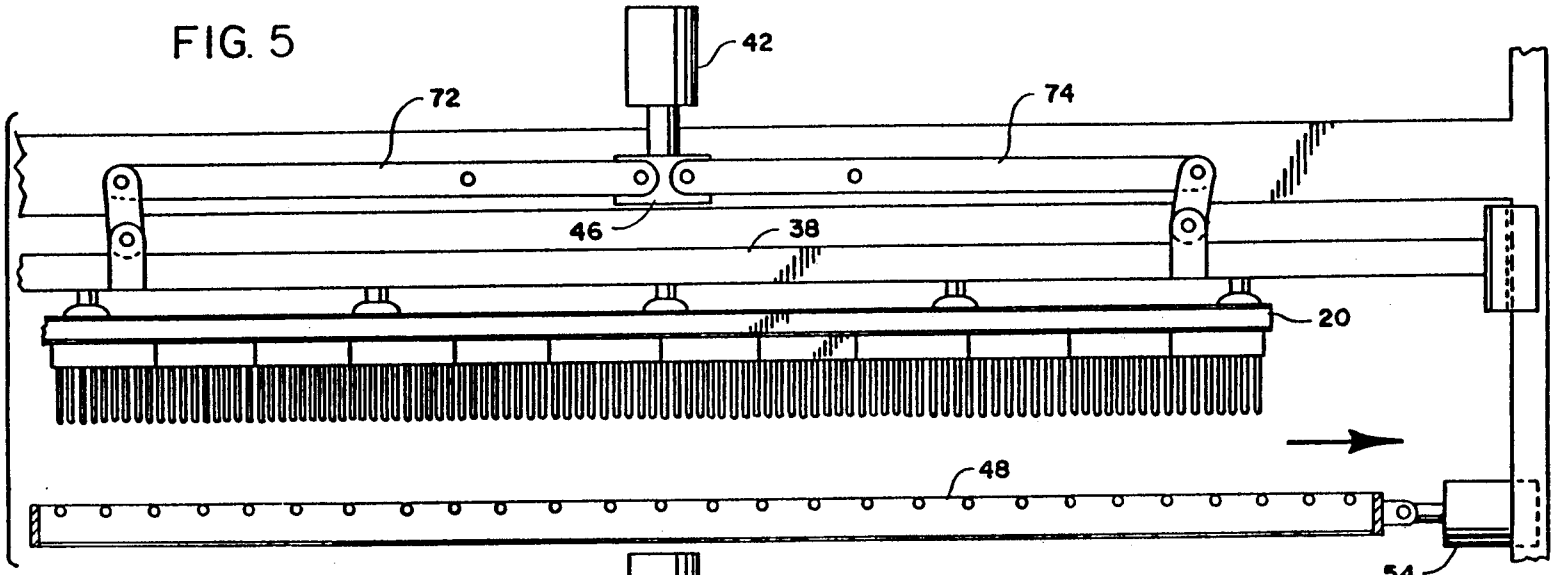
Figure 6:
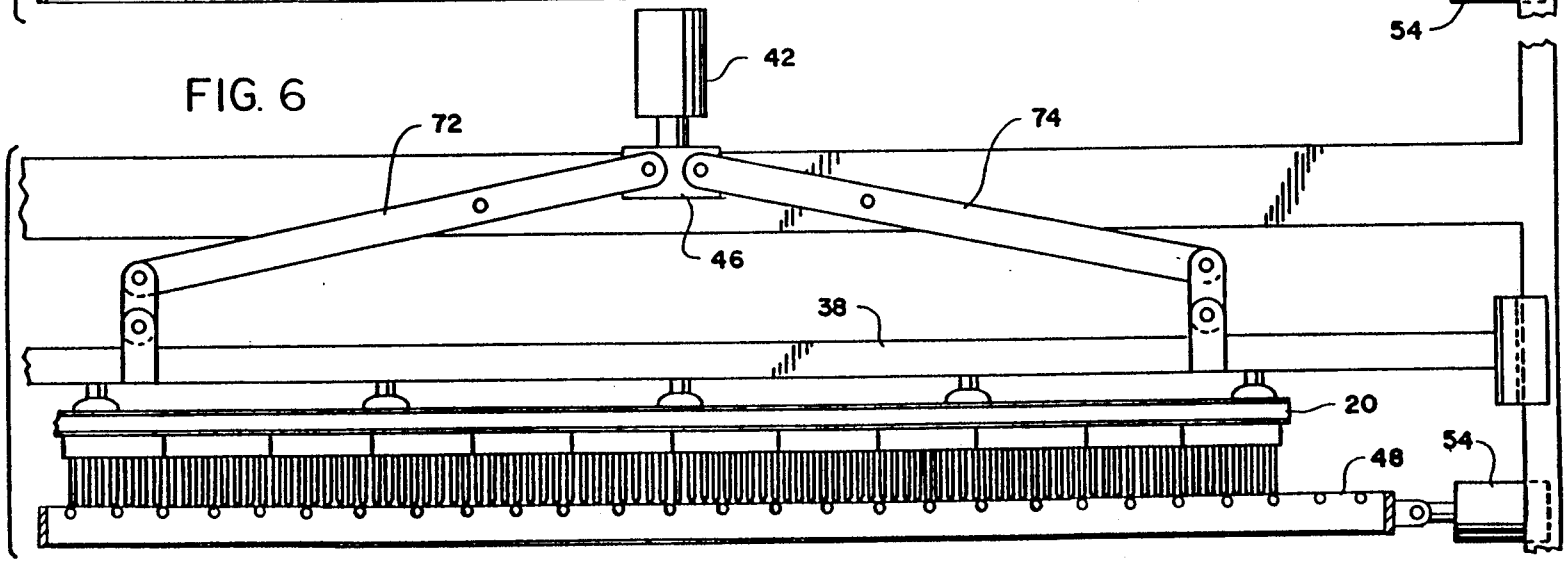

Synchronization between the head 38 and grate 48 is illustrated in FIGS. 3–6. When the head is raised, as illustrated in FIGS. 3 and 5, the compressed air supplied to cylinder 54 is reversed. This causes grate 48 to alternatingly index from right-to-left (FIG. 3) or from left-to-right (FIG. 5) during each raising of head 38. When head 38 travels downwardly toward grate 48, the grate remains stationary. The grate is shifted approximately 90°, or one-quarter of the spacing between lattice members 52, from the position illustrated in FIGS. 3 and 4 and to that illustrated in FIGS. 5 and 6. The grate is shifted so that a different portion of bristle block slat 20 will contact lattice members 52 during successive cycles. Because different portions of slat 20 contact the lattice members 52 during successive cycles of head 38, debris is free to fall from slat 20 regardless of its location in the slat. In other words, debris will not tend to accumulate in the bristles immediately above each lattice member.

Figure 2:
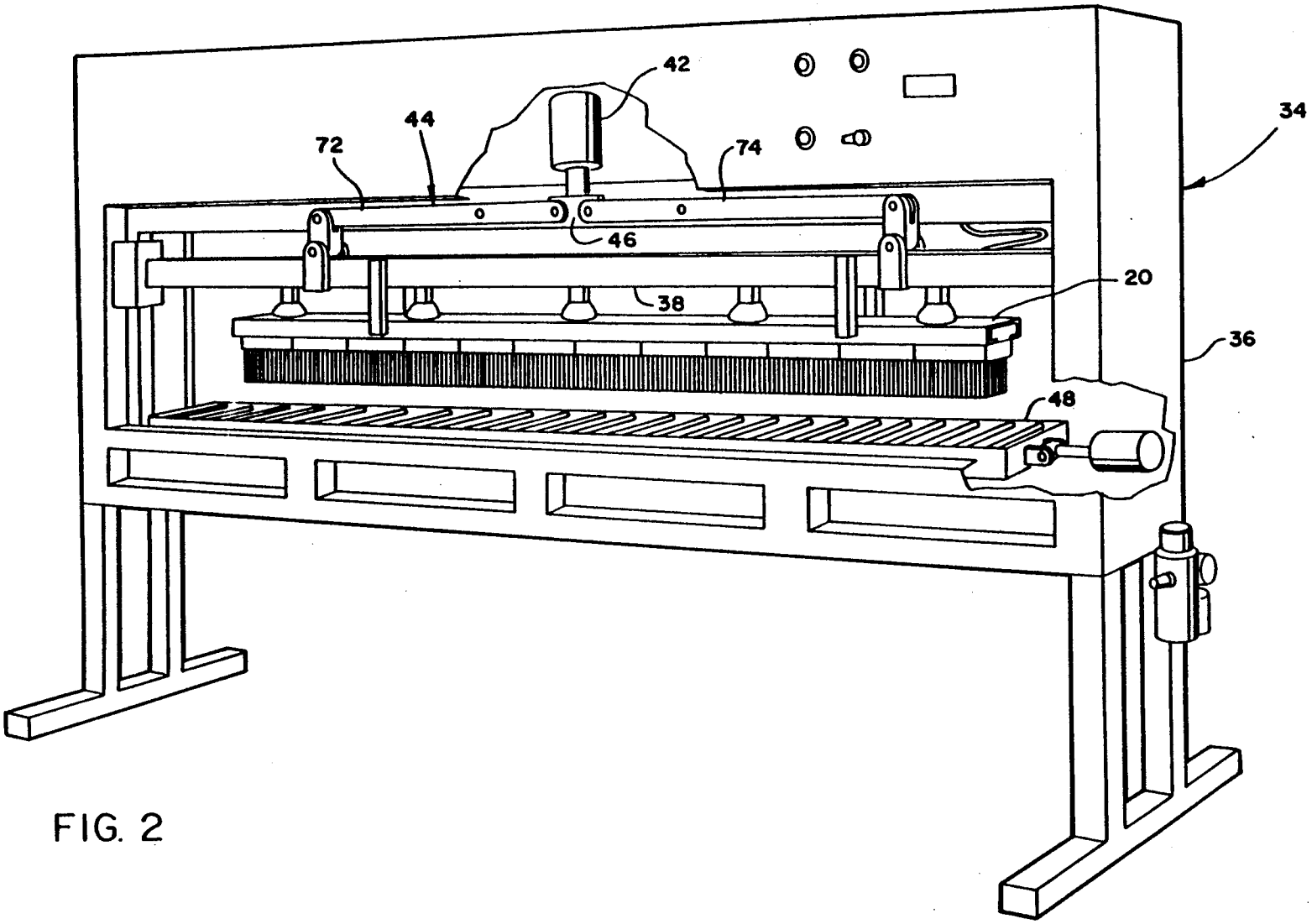
FIG. 2 is the same view as FIG. 1 except that the head is in an upward, or retracted, position.

In order to remove debris from a slat 20, the slat is first submerged in a vat 98 containing water 100, which is preferably at a temperature of 120° F. (FIG. 9). The purpose of the submerging is in order to add weight to the debris and to cause a certain accretion of the particles which increase the dislodging force from apparatus 34. Airborne particles are also reduced. It has been discovered that water at 120° is preferable to room temperature because the nylon or polypropylene material of the bristle blocks expands when heated and subsequently contracts faster than the debris when removed from vat 98. This differential contraction is believed to loosen the interface between the bristles 28 and the debris. After slat 20 has soaked for approximately 1.5 minutes, it is removed from the vat and positioned under elongated member 56 between guide bars 70. Vacuum switch 66 is actuated to draw a suction on slat 20 at cups 60. Start button 92 is actuated, which causes compressed air to flow to cylinders 42 and 54. As extendable portion 46 of cylinder 42 is extended, head 38 is drawn upwardly as seen in FIGS. 2, 3 and 5. When portion 46 is fully extended, it reverses direction and begins to retract, causing head 38 to move downwardly. Head 38 accelerates rapidly, reaching a maximum velocity of approximately 3.3 feet per second. The head then rapidly decelerates to zero velocity as head 38 reaches the position illustrated in FIGS. 1, 4 and 6, at which point bristles 28 contact lattice members 52 of grate 48, which terminates downward motion. Once fully retracted, extendable portion 46 again begins to extend, which draws head 38 to the position illustrated in FIGS. 2, 3 and 5, which begins a new cycle. Grate 48 is indexed from right-to-left or left-to-right when head 38 is drawn to its upward position. After a preset number of cycles of apparatus 34 are complete, counter 102 stops the apparatus. Switch 66 is then actuated to release the slat from the head. Debris, which is removed from slat 20, falls between lattice members 52 to the floor, a pit or other suitable depository.

Changes and modifications in the specifically described embodiments can be carried out without departing from the principles of the invention which is intended to be limited only by the scope of the appended claims, as interpreted according to the principles of patent law including the doctrine of equivalents.

The embodiments of the invention in which an exclusive property or privilege is claimed are defined as follows:

1. An apparatus for removing debris from a substrate comprising:

a head;

support means for supporting said substrate by said head;

mover means for accelerating said head in a given direction, said mover means including means for producing linear movement and linkage means connecting said mover means with said head in a manner that said head is moved a greater amount than said mover means for amplifying said linear movement when applied to said head; and means for decelerating said head after said mover means has accelerated said head;

wherein said linkage means includes an elongated member having first and second opposite ends, said linear movement being applied to one of said opposite ends, the other one of said opposite ends being connected to said head, said linkage means further including means for pivotally mounting said elongated member at a pivot point between said first and second opposite ends, wherein the distance between said pivot point and said one of said opposite ends being less than the distance between said pivot point and said other one of said opposite ends.

2. The apparatus in claim 1 wherein said means for producing linear movement is a fluid-operated extendable cylinder.

3. The apparatus in claim 1 wherein said distance between said pivot point and said first end is approximately one-half of the distance between said pivot point and said second end.

4. The apparatus in claim 3 wherein said means for producing linear movement is a fluid-operated extendable cylinder.

5. The apparatus in claim 1 wherein said means for decelerating said head includes a grate having a plurality of lattice members, said grate being positioned with respect to said head such that a substrate will contact said grate when said head has been accelerated by said mover means.

6. The apparatus in claim 5 further including shifting means for laterally shifting said grate such that the location of the substrate that is contacted by each of said lattice members can be altered.

7. The apparatus in claim 6 in which said shifting means shifts said grate whenever said head is moved by said mover means away from said grate.

8. The apparatus in claim 1 in which said support means includes suction means for drawing a vacuum between said head and a substrate in order to adhere said substrate to said head.

9. The apparatus in claim 8 wherein said suction means includes a venturi nozzle for producing a suction force when actuated with compressed air and suction cup means attached to said head and pneumatically connected with said venturi nozzle.

10. An apparatus for removing debris from a substrate comprising:

a frame;

a head assembly vertically reciprocal with respect to said frame, said head assembly including means for mounting a substrate thereto;

an extendable force producing device connected with said frame;

linkage means connected with said force producing device and said head assembly for transmitting force from said force producing device to said head assembly to reciprocally move said head assembly along a path, said linkage means including an elongated member pivotally mounted at a pivot point to said frame, first connecting means for connecting a first portion of said elongated member to said force producing device and second connecting means for connecting a second portion of said elongated member to said head, the distance between said pivot and said first connecting means being less than the distance between said pivot and said second connecting means; and an abutment positioned in said path for contacting said substrate and thereby dislodge debris therefrom.

11. The apparatus in claim 10 in which said linkage means further includes a second elongated member pivotally mounted at a second pivot point to said frame, third connecting means for connecting a first portion of said second elongated member to said force producing device and fourth connecting means for connecting a second portion of said second elongated member to said head, the distance between said second pivot and said third connecting means being less than the distance between said second pivot and said fourth connecting means.

12. The apparatus in claim 11 in which said pivot is located between said first and second connecting means and said second pivot is located between said third and fourth connecting means.

13. The apparatus in claim 10 in which said pivot is located between said first and second connecting means.

14. The apparatus in claim 10 wherein said extendable force producing device is a fluid actuated cylinder.

15. The apparatus in claim 10 wherein said abutment includes a horizontal grate having a plurality of lattice members defining a horizontal surface, said surface being positioned vertically below said head in said path.

16. The apparatus in claim 15 further including grate indexing means for laterally indexing said grate, said indexing means being synchronized with reciprocable movement of said head.

17. An apparatus for removing debris from a substrate comprising:

mover means for inducing reciprocal movement in a substrate toward and away from a given location;

a grate having a plurality of lattice members, said grate being positioned at said given location such that a substrate will contact said lattice members when reciprocated toward said given location; and indexing means for laterally indexing the positional relationship between said grate and said mover means such that different portions of a substrate will contact said lattice members.

18. The apparatus in claim 17 wherein said indexing means is synchronized with said reciprocal movement induced by said mover means.

19. The apparatus in claim 18 in which said indexing means is actuated in response to said mover means inducing movement in a substrate away from said given location.

20. The apparatus in claim 19 in which said indexing means is actuated less often than every cycle of said mover means.

21. The apparatus in claim 17 wherein said apparatus includes a frame and said mover means induces vertical reciprocal movement of a substrate with respect to said frame and further wherein said indexing means includes means for adjusting the lateral position of said grate with respect to said frame.

22. An apparatus for removing debris from a bristle member comprising:

a head extending in a plane;

support means for fixedly supporting a bristle member to said head in said plane whereby any motion imparted to said head is imparted to said bristle member;

mover means for reciprocally moving said head perpendicular to said plane from a first position to a second position during a first portion of a cycle and from said second position to said first position during a second portion of said cycle; and said mover means selectably controlling the velocity of said head at all times during both said first and second cycle portion in a manner that said head achieves a substantially greater velocity during said first portion than during said second portion such that debris dislodged during said first portion will not be relodged during said second portion and cycle speed can be maximized to enhance debris dislodging; and a generally planar grate positioned at said second position oriented generally parallel said plane in order to interrupt the movement of said head to abruptly decelerate said head at said second position.

23. The apparatus in claim 22 wherein said moving means reciprocates said head at a rate of 1.5 to 2 cycles per second.

24. An apparatus for removing debris from a bristle member comprising:

a head extending in a plane;

support means for fixedly supporting a bristle member to said head in said plane whereby any motion imparted to said head is imparted to said bristle member;

mover means for reciprocally moving said head perpendicular to said plane from a first position to a second position during a first portion of a cycle and from said second position to said first position during a second portion of said cycle;

said mover means controlling the velocity of said head at all times during both said first and second cycle portion such that said head achieves a substantially greater velocity during said first portion than during said second portion such that debris dislodged during said first portion will not be relodged during said second portion;

a generally planar grate positioned at said second position oriented generally parallel said plane in order to interrupt the movement of said head to abruply decelerate said head at said second position; and shifting means for shifting said grate along an axis that is generally parallel said plane.

25. The apparatus in claim 24 wherein said shifting means shifts said grate when said head is in said second position.

26. The apparatus in claim 24 wherein said shifting means shifts said grate every other cycle of said moving means.

27. An apparatus for removing debris from a substrate comprising:

mover means for inducing reciprocal movement in a substrate toward and away from a given location;

a grate having a plurality of lattice members, said grate being positioned at said given location such that a substrate will contact said lattice members when reciprocated toward said given location; and indexing means for indexing the positional relationship between said grate and said mover means such that different portions of a substrate will contact said lattice members.

28. The apparatus in claim 27 wherein said indexing means is synchronized with said reciprocal movement induced by said mover means.

29. The apparatus in claim 28 in which said indexing means is actuated in response to said mover means including movement in a substrate away from said given location.

* * * * *